US005758971A

United States Patent [19]

Goglio et al.

[11] Patent Number: 5,758,971

[45] Date of Patent: Jun. 2, 1998

[54] CONTAINER MADE OF FLEXIBLE MATERIAL WITH A HANDLE SYSTEM FORMED WITHOUT EXTERNAL ADDED MATERIAL

[75] Inventors: Franco Goglio, Milan; Giorgio Bottini, Gallarate; Luigino Bianconi, Daverio, all of Italy

[73] Assignee: Goglio Luigi Milano Spa, Milan, Italy

[21] Appl. No.: 638,787

[22] Filed: Apr. 29, 1996

[30] Foreign Application Priority Data

Jun. 23, 1995 [IT] Italy ..... MI950448 U

[51] Int. Cl.[6] ..... B65D 33/08

[52] U.S. Cl. ..... 383/10; 383/17

[58] Field of Search ..... 383/8, 10, 17, 383/76, 77

[56] References Cited

U.S. PATENT DOCUMENTS

| | | | |
|---|---|---|---|
| 2,433,867 | 1/1948 | Ringler | 383/10 |
| 4,481,668 | 11/1984 | Hammacher | 383/10 X |
| 5,458,556 | 10/1995 | Hlubik | 383/10 X |

FOREIGN PATENT DOCUMENTS

| | | | |
|---|---|---|---|
| 2676989 | 12/1992 | France | 383/10 |
| 1923410 | 11/1970 | Germany . | |
| 3829056 | 11/1989 | Germany | 383/8 |
| 825159 | 12/1959 | United Kingdom . | |

*Primary Examiner*—Jes F. Pascua

*Attorney, Agent, or Firm*—Burns, Doane, Swecker & Mathis, L.L.P.

[57] ABSTRACT

A container made of flexible material, in particular of the so-called bellows type, obtained by successive folding and welding of a sheet material provided with a handle system at its top edge (5), consisting of a cut (9) made in the central part (10) of said edge, in which to insert the fingers, said central part (10) of the edge (5) being reinforced by carrying over onto it material from the outer ends (8) of this edge itself.

14 Claims, 4 Drawing Sheets

CONTAINER MADE OF FLEXIBLE MATERIAL WITH A HANDLE SYSTEM FORMED WITHOUT EXTERNAL ADDED MATERIAL

BACKGROUND AND SUMMARY

The present invention relates to a container made of flexible material, provided with a handle system without external added material.

Containers made of flexible material, for example of the so-called bellows type, are widely known and are used to package products of various types, for example granules, powders and the like, under vacuum or otherwise.

They are obtained from a single- or multi-layered material, one or both outer faces being heat sealable, for example of polyethylene. The package is obtained in a per se known manner, by successive folding, making transverse and longitudinal joints between superimposed parts of the heat-sealable layers.

These known containers are not normally provided with a handle system.

This poses no problems for small containers, such as packets of coffee and the like.

For larger and therefore heavier packages, on the other hand, there are difficulties in handling and transport.

In these cases, provision of an opening obtained by punch cutting at the top of the container, in which to insert the fingers of one hand, cannot be relied upon, since it tends to tear because of the weight of the product contained in the package.

Use is therefore often made of applied handles, which are not very practical and add to the cost and the weight of the container. Moreover, these applied handles are generally not of the same material as the container, hence there are recycling problems.

Some solutions involve application of a reinforcing material to the flattened centre top part of the package, before punch cutting to obtain the handle opening.

These solutions present essentially the same drawbacks as applied handles.

The aim of the invention is to overcome the above drawbacks, providing a container of flexible material that has a handle system without external added material, and which has an extremely light structure and a size in keeping with the product it must contain and is therefore extremely economical.

The invention arises from the observation that in containers, particularly in those of the so-called bellows type, the top flattened edge has a rather weak central part because it is formed by two superimposed sheets of material, corresponding to the two faces of the container, whilst the side parts are stronger, since there are folds in the material and therefore a plurality of superimposed sheets, in particular four.

According to the invention, provision is made for the material present at the sides of the top edge of the container to be brought into central part of said edge.

According to an embodiment of the invention, this is achieved by outwardly folding the side portions of the upper edge of the container towards the centre, after making appropriate cuts.

According to another embodiment, this is achieved by inwardly pulling the two side portions of the bellows towards the centre.

In both cases, after folding an opening is made in the reinforced central part, for example by punch cutting, to obtain the handle.

The cuts that are made before the folds advantageously curve slightly upwards at the end, so as to form an arch-shaped rather than right-angled connection for the resulting central part, forming the carrying handle.

Provision can also be made, during punch cutting of the handle opening, for rounded cutting of the outer edges of said central portion.

Obviously the edges of the folds are intended to be sealed or glued to give solidity to the handle system thus obtained.

BRIEF DESCRIPTION OF THE DRAWINGS

Further characteristics of the invention will be made clearer by the detailed description that follows, which refers to purely exemplary and therefore non-limiting embodiments thereof illustrated in the attached drawings, in which.

DETAILED DESCRIPTION

With reference to these figures, the container according to the invention has been indicated as a whole by reference number 1.

It is made of flexible material, in one or more layers, which can be heat-sealable on both its faces.

Figure 4:
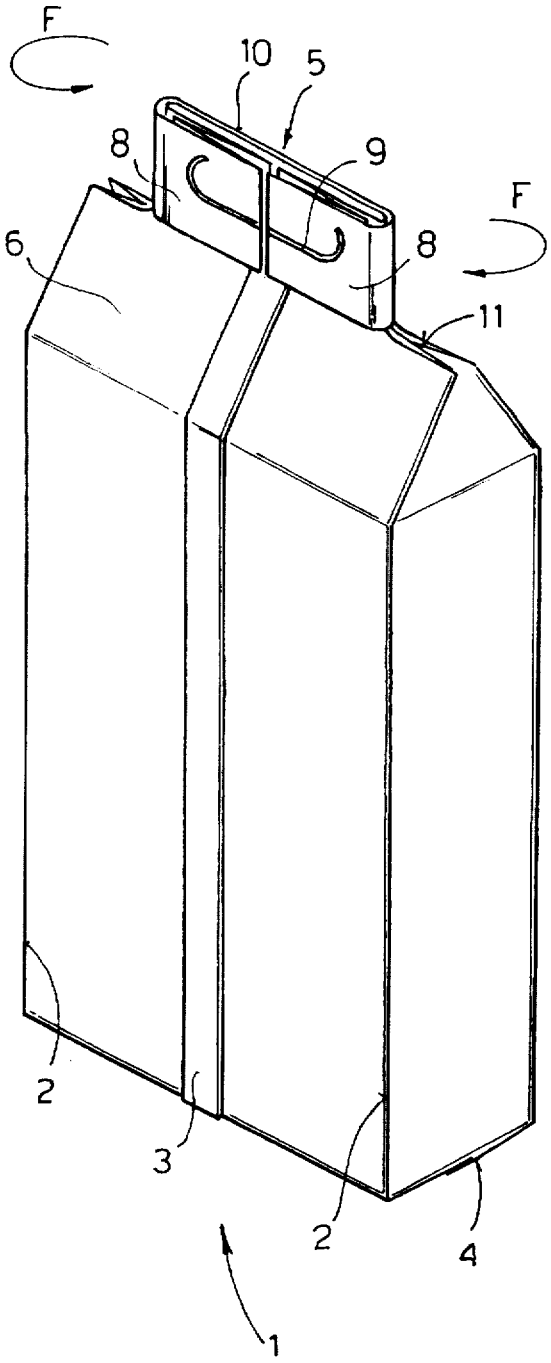
FIG. 4 shows a first embodiment of open outline handle system.
Figure 5:
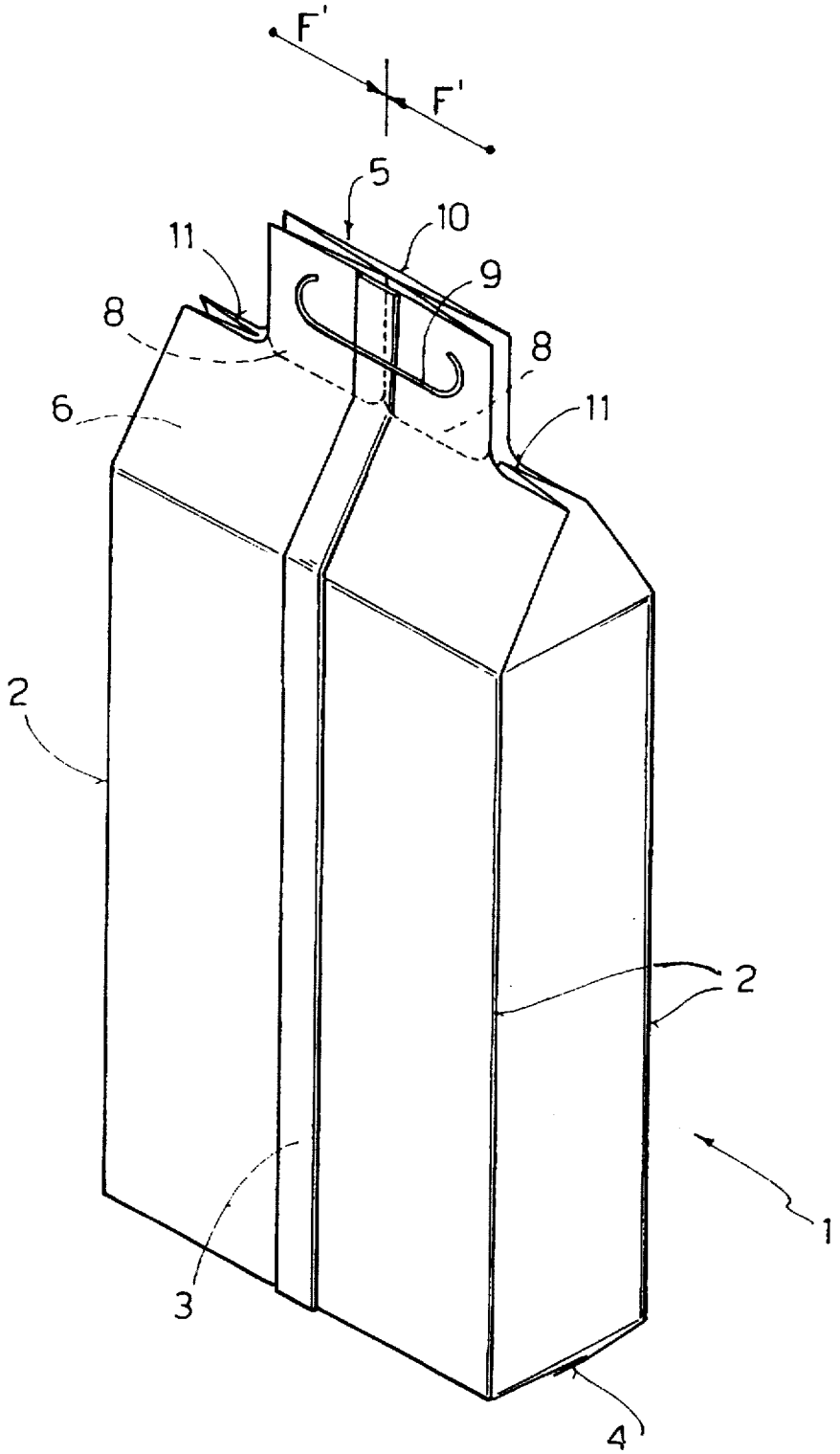
FIG. 5 shows a second embodiment of the open outline handle system.

The container 1 can be packaged under vacuum or otherwise, as shown in FIGS. 4 and 5, and is of the so-called bellows type, that is, it is obtained by making folds along vertical fold lines 2 corresponding to its vertical edges, and making a vertical or longitudinal seal 3, which is disposed on a side surface of the container. The procedure for making the container can be considered known, so it will not be further described.

Figure 1:
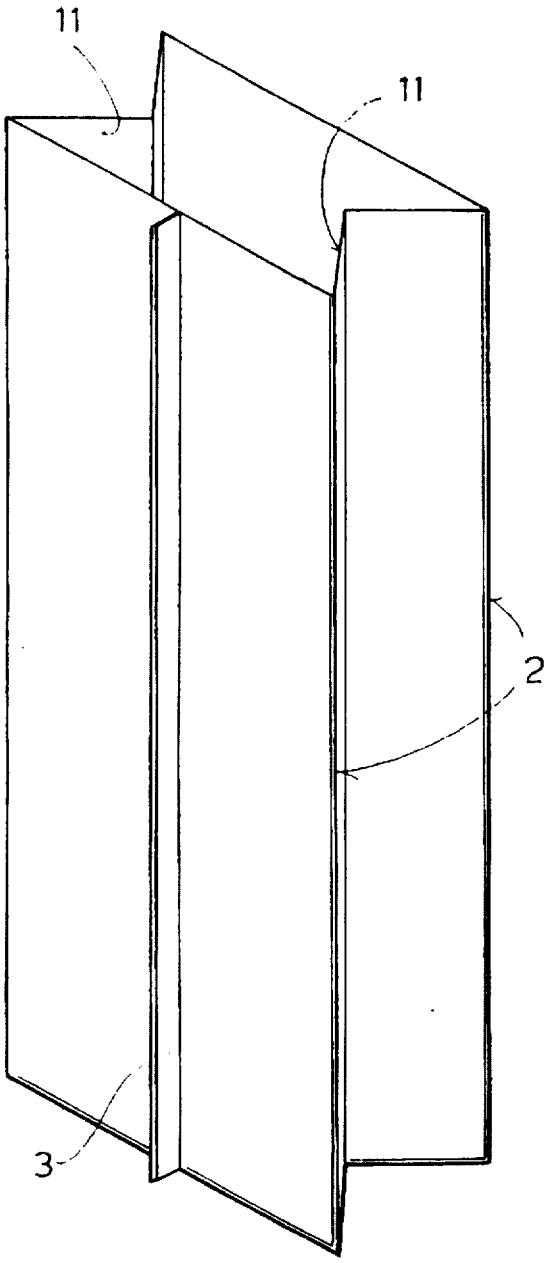
FIGS. 1 and 2 illustrate two successive stages in the procedure for making a bellows container, to be considered per se known.
Figure 2:
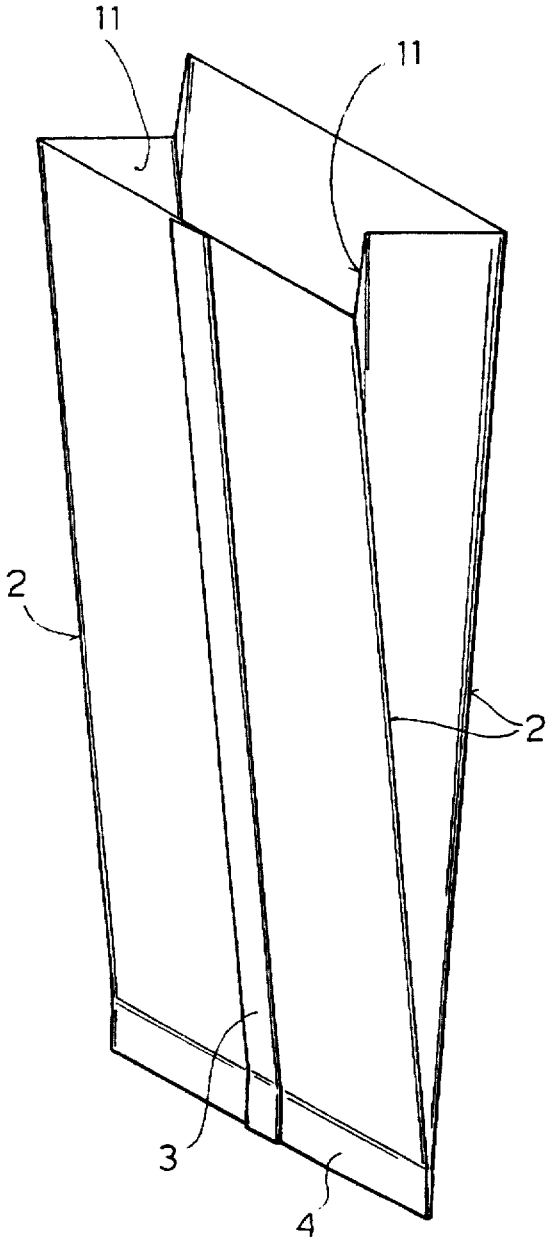
Figure 3:
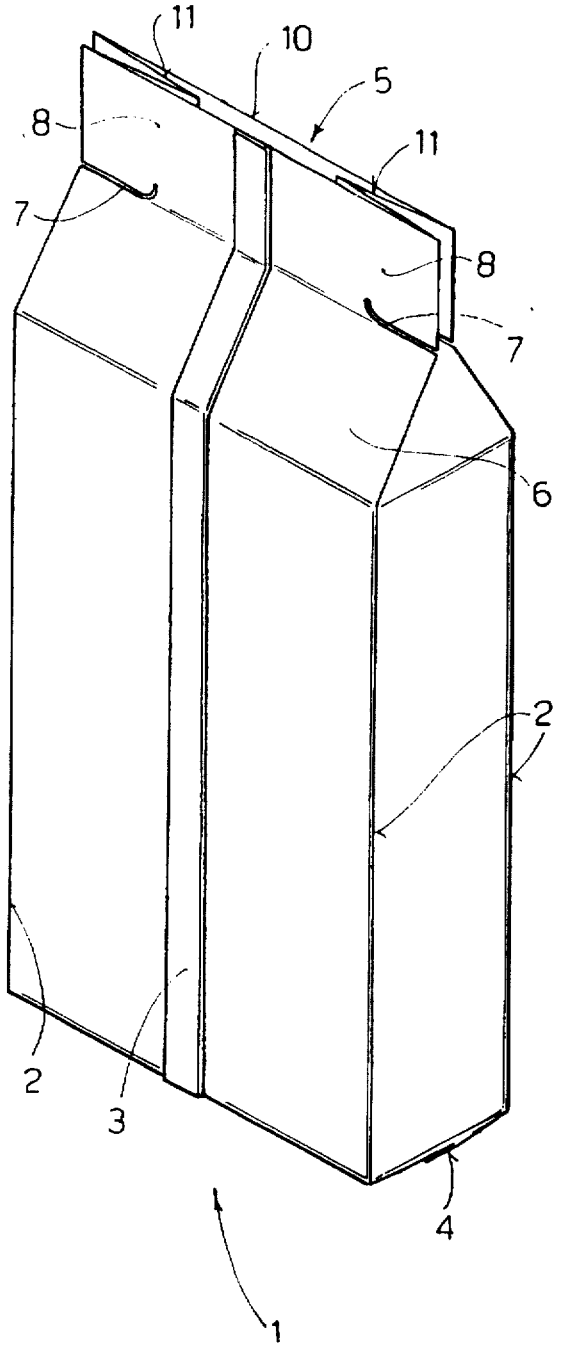
FIG. 3 is a schematic perspectives view of a bellows container filled with product, on the upper edge of which cuts have been made to obtain the handle system according to the invention.

The container 1, once it is made, appears as shown in FIG. 3, where a further transverse seal can be provided at its top, sealing it hermetically.

The top transverse edge 5 of the container 1 is flattened and, according to the known art, is normally folded over the upper wall 6 of said container.

According to the invention, on the other hand, said edge 5 is kept in an upright position, as shown in FIG. 3, and is used to obtain a handle system for the container, in the manner described below.

Horizontal cuts 7 are made at the two sides of the edge 5, with the inner ends advantageously curved slightly upwards.

Two free ends 8 are thus formed which, according to the invention, are brought into the central part of the top edge 5 to reinforce said part, in which the carrying handle is then made.

As shown in the embodiment in FIG. 4, the free ends 8 are folded on the outside over the central part of the edge 5, as indicated by the arrows F, and are fixed to said central part by sealing and gluing. A sealing or gluing line is also advantageously foreseen immediately below the cuts 7

A cut 9 is subsequently made through both the central part 10 of the edge 5 and the folded ends 8, so as to form an opening for the fingers, thus forming a carrying handle.

Figure 6:
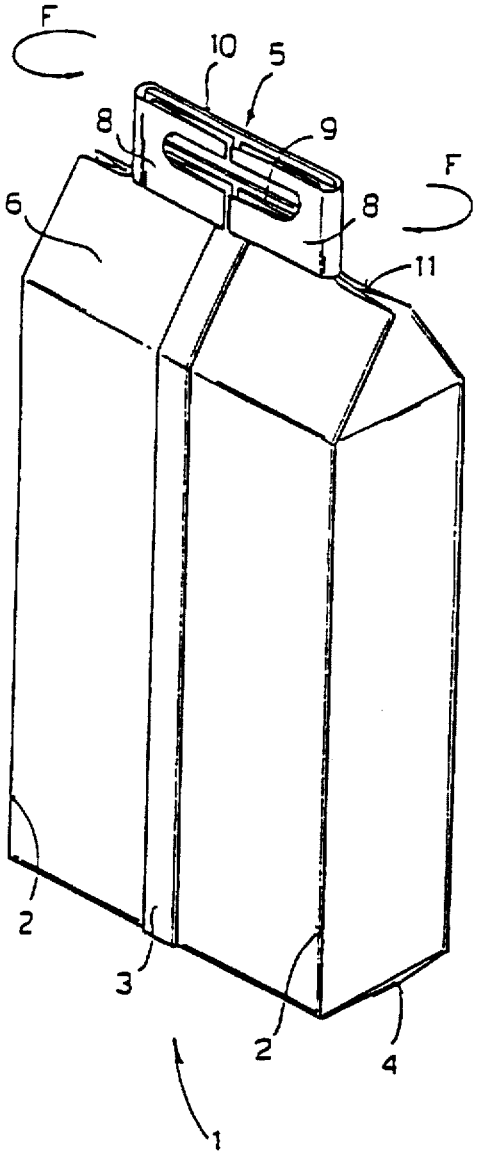
FIG. 6 shows an embodiment of a closed outline handle system.

The cut 9 in FIG. 4, obtained for example by punch cutting, forms an open outline handle, as shown. The handle can alternatively have a closed outline, as shown in FIG. 6, in which the cut 9*a* causes the removal of the material defined by the cut The embodiment in FIG. 5 differs form that in FIG. 4 solely in the fact that the two free ends 8, instead of being folded outwards, are pulled inwards, so that they come to be inside the central part 10 of the edge 5. In this case sealing or gluing then follow and the cut 9 is made to obtain the carrying handle.

Figure 7:
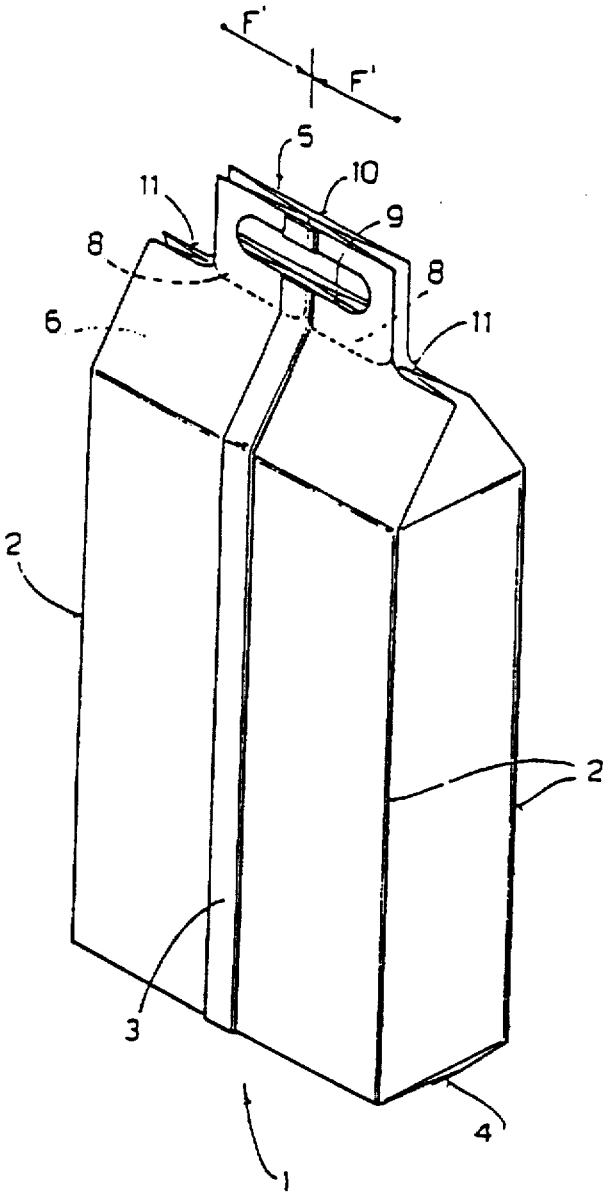
FIG. 7 is an alternative embodiment of the closed outline handle system.

FIG. 7 shows a closed handle embodiment in which the free ends 8 are also folded inwards to be in the central part 10 of the edge 5.

In FIGS. 4 and 5 the two free ends 8 of the upper edge 5 of the container are turned back over the central part 10 of said edge to the point of covering their entire surface. It is obvious, however, that a space can be left in the middle whilst still achieving the same aim, which is to reinforce the handle area by means of the material present at the sides of said edge, where four superimposed sheets were originally present because of the bellows folds 11.

If it is wished to improve the appearance of the handle system according to the invention, rounding of the cut at the upper edges of the handle can be carried out, for example, when the cut 9 is made.

Although particular reference has been made in the above to bellows-type containers the invention can obviously be applied to other types of container without side bellows, for example envelope-type containers.

From what has been described the advantages of the container made of flexible material according the invention are obvious, in that it offers the user a convenient, solid handle, obtained by moving the container material itself from one area to another, which also allows complete recycling of the package after use.

What is claimed is:

1. A container made of flexible material, comprising a sheet of material folded and sealed to define an interior having narrow side panels and wide from and back panels, and a closed top edge portion formed by the narrow side panels folded inward and overlapped by the wide front and back panels, and having a handle system at the top edge portion formed by an outline cut in a central part of the top edge portion, and reinforcing means in at least a portion of said central part of the top edge portion comprising material from laterally outer ends of the top edge portion lapping at least a portion of said central part, wherein said material is defined by cuts extending from lateral ends of the top edge portion toward the central part to form free ends including portions of the front panel, the back panel and the side panels, and wherein the free ends are folded toward said central part of the top edge portion.

2. A container according to claim 1, wherein said free ends are folded over said central part of the top edge portion.

3. A container according to claim 1, wherein said free ends are folded inside the central part.

4. A container according to claim 1, wherein inner extremities of said cuts forming the free ends curve upwards toward an end edge of the top edge portion.

5. A container according to claim 1, wherein the cut forming the handle has an open outline.

6. A container according to claim wherein the cut forming the handle has a closed outline, causing removal material corresponding to a surface area enclosed by closed outline.

7. A container of flexible material having a handle at a top portion, formed by the steps of:

folding and sealing a sheet of material to define an interior bounded at least by opposing front and back panels and opposing side panels;

forming a closure in a top end portion by folding the side panels inward along a center line and between and in overlapping contact with the front and back panels the top end portion being separated from a main portion of the container by a fold line;

cutting along the fold line from opposite outer edges of the top end portion toward an center axis of the package to form lateral flaps on opposite sides of a central part;

folding the lateral flaps to lap the central part; and making a cut in the central part and lapped flaps to form a handle.

8. A container of flexible material, comprising a sheet of material folded and sealed to define a main portion having front and back panels and side panels enclosing an interior, and a top end portion with the side panels folded inward and the front and back panels overlapping the side panels, wherein the top end portion includes opposite lateral flaps separated from the main portion by laterally inward cuts, the flaps each including portions of the front panel, back panel, and side panels, wherein remaining portions of the front panel, back panel and side panels connect the top end portion to the main portion, the flaps being folded to lap a central part of the top end portion, and wherein the top end portion includes a handle formed by an outline cut in the central portion and lapped flaps.

9. The container as claimed in claim 8, wherein the flaps are positioned to overlap an exterior surface of the central part.

10. The container as claimed in claim 8, wherein the flaps are positioned between the front and back panels.

11. The container as claimed in claim 8, wherein the outline cut forming the handle is substantially C-shaped and concave toward a free end of the top end portion.

12. The container as claimed in claim 8, wherein the cut outline forming the handle forms a hole in the central portion and lapped flaps.

13. The container as claimed in claim 8, wherein the container is a bellows-type container formed from a single substantially rectangular sheet of material.

14. A container made of flexible material, comprising a sheet of material folded and sealed to define an interior and having a handle system at a top edge portion formed by an outline cut in a central part of the top edge portion, and reinforcing means in at least a portion of said central part of the top edge portion comprising material from laterally outer ends of the top edge portion lapping at least a portion of said central part, said material defined by cuts extending from lateral ends of the top edge portion toward the central part to form free ends and the free ends are folded over said central part of the top edge portion, wherein inner extremities of said cuts forming the free ends curve upwards toward an end edge of the top edge portion.

* * * * *